US007043792B2

(12) United States Patent
Kessler

(10) Patent No.: US 7,043,792 B2
(45) Date of Patent: May 16, 2006

(54) FLOOR MAT SYSTEM WITH FLANGED COVER

(75) Inventor: Ronald N. Kessler, Girard, OH (US)

(73) Assignee: R&L Marketing & Sales, Inc., Youngstown, OH (US)

( * ) Notice: Subject to any disclaimer, the term of this patent is extended or adjusted under 35 U.S.C. 154(b) by 352 days.

(21) Appl. No.: 10/125,874

(22) Filed: Apr. 19, 2002

(65) Prior Publication Data

US 2003/0196288 A1 Oct. 23, 2003

(51) Int. Cl.
*A47L 13/02* (2006.01)

(52) U.S. Cl. ..... 15/215; 15/216; 15/217; 15/238; 52/177; 428/45; 428/47

(58) Field of Classification Search ..... 15/215, 15/216, 217, 238, 239, 240; 428/45, 47, 428/58, 48, 120, 167; 52/177, 664, 180, 52/181, 668
See application file for complete search history.

(56) References Cited

U.S. PATENT DOCUMENTS

| | | | | |
|---|---|---|---|---|
| 1,483,095 | A | 2/1924 | Kain | |
| 2,070,839 | A | 2/1937 | Place | |
| 3,158,962 | A | 12/1964 | Faase | |
| 3,742,671 | A | 7/1973 | Ellis | |
| 3,808,628 | A * | 5/1974 | Betts | 15/215 |
| 3,846,945 | A | 11/1974 | Rohy | |
| 4,029,834 | A | 6/1977 | Bartlett | |
| 4,143,194 | A | 3/1979 | Wihksne | |
| 4,167,599 | A | 9/1979 | Nissinen | |
| 4,361,614 | A | 11/1982 | Moffitt, Jr. | |
| 4,361,925 | A | 12/1982 | Yamamoto et al. | |
| 4,415,620 | A | 11/1983 | Yamazaki et al. | |
| 4,468,910 | A | 9/1984 | Morrison | |
| 4,654,245 | A * | 3/1987 | Balzer et al. | 428/52 |
| 4,727,697 | A | 3/1988 | Vaux | |
| 4,796,399 | A | 1/1989 | Kessler et al. | |
| 4,798,029 | A | 1/1989 | Carlton | |
| 4,822,658 | A | 4/1989 | Pacione | |
| 4,877,672 | A | 10/1989 | Shreiner | |
| 4,963,054 | A | 10/1990 | Hayashi | |
| 5,191,692 | A | 3/1993 | Pacione | |
| 5,323,575 | A | 6/1994 | Yeh | |

(Continued)

FOREIGN PATENT DOCUMENTS

| | | |
|---|---|---|
| DE | 44 07 231 | 9/1995 |

(Continued)

OTHER PUBLICATIONS

Verimpex Entrance Matting Systems Catalog.

(Continued)

*Primary Examiner*—John Kim
*Assistant Examiner*—Abraham Bahta
(74) *Attorney, Agent, or Firm*—Sand & Sebolt

(57) ABSTRACT

A floor mat system having a plurality of floor mats and a frame assembly which prevents the floor mats from lifting and causing a tripping hazard to persons walking thereover. The floor mats may include carpeted sections over a plurality of orthagonally disposed spaced ribs. The frame assembly includes inner and outer frame members which extend between and around the floor mats, respectively. The inner fame members are T-shaped having a pair of horizontally disposed wings and the outer frame members are ramped and include a horizontally disposed upper flange. The wings and upper flanges which extend over peripheral edge portions of the floor mats to vertically retain them, the inner and outer frame which may be secured to the floor.

40 Claims, 3 Drawing Sheets

U.S. PATENT DOCUMENTS

| | | | | |
|---|---|---|---|---|
| 5,403,637 | A | 4/1995 | Pickard et al. | |
| 5,486,392 | A | 1/1996 | Green | |
| 5,509,244 | A | 4/1996 | Bentzon | |
| 5,628,160 | A | 5/1997 | Kung | |
| 5,881,427 | A * | 3/1999 | Offner | 15/215 |
| 5,882,764 | A | 3/1999 | Kessler et al. | |
| 5,919,540 | A * | 7/1999 | Bailey | 428/67 |
| 5,958,538 | A | 9/1999 | Kessler | |
| 6,042,915 | A | 3/2000 | Kessler | |
| 6,068,908 | A | 5/2000 | Kessler et al. | |
| 6,127,015 | A * | 10/2000 | Kessler | 428/45 |
| 6,219,876 | B1 * | 4/2001 | Blum | 15/215 |
| 6,635,331 | B1 * | 10/2003 | Kessler | 428/100 |
| 6,663,937 | B1 | 12/2003 | Ullman et al. | |
| 6,884,489 | B1 * | 4/2005 | Kessler | 428/100 |

FOREIGN PATENT DOCUMENTS

| | | |
|---|---|---|
| EP | 0 059 886 | 9/1982 |
| EP | 0 289 880 | 9/1988 |
| EP | 0 359 478 | 3/1990 |
| EP | 0 365 869 | 5/1990 |
| EP | 0 676 169 | 10/1995 |
| EP | 1 038 493 A2 | 9/2000 |
| GB | 2 066 061 A | 7/1981 |
| GB | 2 136 472 A | 9/1984 |
| GB | 87121 32.8 | 2/1998 |
| WO | WO 96/36268 | 11/1996 |

OTHER PUBLICATIONS

Nuway Entrance Matting Catalog.
Nuway Matting Systems, Inc. Catalog.
Front Runner Matting Catalog.
Hi-Rib Rubber Mats Catalog.
Verimpex Entrance Matting Catalog.
Vina-Cir Catalog.
DeCoir Ti-Grid System Catalog.
Flexigrid Catalog.
Ancillaries Price List.

* cited by examiner

FLOOR MAT SYSTEM WITH FLANGED COVER

BACKGROUND OF THE INVENTION

1. Technical Field

Generally, the invention relates to a floor mat system. Particularly, the invention relates to a floor mat system which includes a frame which is disposable on the floor and one or more floor mats positionable within the frame. Specifically, the invention relates to a floor mat system which includes outer frame members having a ramped upper surface and defining a periphery of an area to be covered by the floor mat system and inner frame members which divide the area into wells which receive the floor mats, the outer frame members having an upper flange which extends inwardly over a peripheral portion of the plurality of floor mats and the inner frame members having a pair of wings which extends inwardly over a peripheral portion of the individual floor mats to prevent lifting of the floor mats during use.

2. Background Information

Floor mats are often used at the entrances of businesses for customers to wipe water and snow from the bottoms of their shoes. Conventional floor mats are typically constructed of a flexible rubber material with a plurality of spaced apart orthogonal ribs formed therein which define a plurality of rectangular openings. They may be covered by strips of carpet disposed between parallel ribs. These floor mats are may require a recessed area to be built into the floor where the floor mats are to be located for later installation. The recessed area retains the floor mats abutting together and from sliding movement when walked upon by people. The recessed area somewhat helps in reduce the tripping hazard presented by the otherwise elevated position of the peripheral edges of the floor mats to persons walking over the floor mats. The peripheral edges of the floor mats, particularly those which utilize strips of carpet which can tear loose from the underlying floor mat, are still prone to take a permanent upward set or curl due to inadvertent kicking thus presenting a tripping hazard unless the floor mats are secured directly to the floor.

Another type of floor mat sets on non-recessed floors, but is part of a floor mat system that includes a ramped frame assembly comprised of a plurality of outer frame members which are secured directly to the floor in an attempt to lessen the tripping hazard Peripheral edges of the floor mats of this floor mat system are still prone to be lifted due and take a permanent set or curl due to inadvertent kicking unless secured directly to the floor. Law suits due to injuries incurred by tripping on either such floor mats and floor mat systems still cost retailers and other such businesses which use them millions of dollars each year.

Therefore, the need exists for an improved floor mat system having a plurality of outer frame members with respective horizontally disposed upper flanges and which may include one or more inner frame members having pairs of horizontally disposed wings, the upper flanges and wings which extend over and retain peripheral edge portions of the floor mats from lifting so as to prevent tripping over such peripheral edge portions. Additionally, there exists a need for such a floor mat system which requires no recess in the floor, having ramped outer frame members which along with the inner frame members may be connected to each other and/or to the floor. Further additionally, there exists a need for such a floor mat system wherein the individual floor mats are removable to clean the floor below the floor mats.

SUMMARY OF THE INVENTION

Objectives of the invention include providing a floor mat system which includes inner and outer frame members which prevents carpet pieces at peripheral edge portions of the floor mats from lifting from a base thereof and presenting a tripping hazard to persons walking thereon.

A further objective is to provide a floor mat system in which the carpet pieces are removably connectable to permit cleaning and replacement by using interlockable patches of hook and loop fasteners affixed to the underside of the pieces of carpet and the base of the floor mats.

A further objective is to provide a floor mat system in which the inner and/or outer frame members may be secured to the floor yet the individual floor mats may be removed from the frame assembly to allow clean-up dirt, debris, or water under the floor mat and placed back within the frame assembly after clean-up.

A further objective is to provide a floor mat system which is easily installed on top of a floor without any modifications to the floor such as a recess or the use of fasteners.

A further objective is to provide a floor mat system which includes a frame assembly and floor mats which are removably attachable together to form an integral unit which does not require securing to the floor and which when not secured to the floor is less prone to movement and slippage on the floor than other such non-secured floor mat systems due to the larger size of the integral unit.

A further objective is to provide a floor mat system which allows water to be directed as desired to evenly disperse the water under the floor mats by selectively placing seals under the inner frame members.

Yet another objective is to provide such a floor mat system in which the outer periphery of the mats may be sealed by placing seals under the outer frame members of the frame assembly to prevent the flow of water thereunder.

A further objective is to provide a floor mat system utilizes simplified resilient tubular seals in the outer frame members.

A still further objective is to provide a floor mat system which utilizes a pair of seals in each outer frame member to provide additional sealing protection.

Another objective of the invention is to provide a floor mat system which is of simple construction, which achieves the stated objectives in a simple, effective, and inexpensive manner and which solves problems and satisfies needs existing in the art.

These objectives and advantages are obtained by the improved floor mat system of the present invention, the general nature of which may be stated as including a floor mat system adapted to lay on floor, the system including: a floor mat adapted to lay on the floor; and a frame assembly which includes at least one outer frame member having a horizontally dispose upper flange and which may have one or more inner frame members having a pair of horizontally disposed wings, the inner and outer frame members being adapted to lay on the floor positioned adjacent to the mat with the respective wings and upper flanges disposed over and vertically retaining respective outer peripheral portions of the floor mats.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

Figure 1:
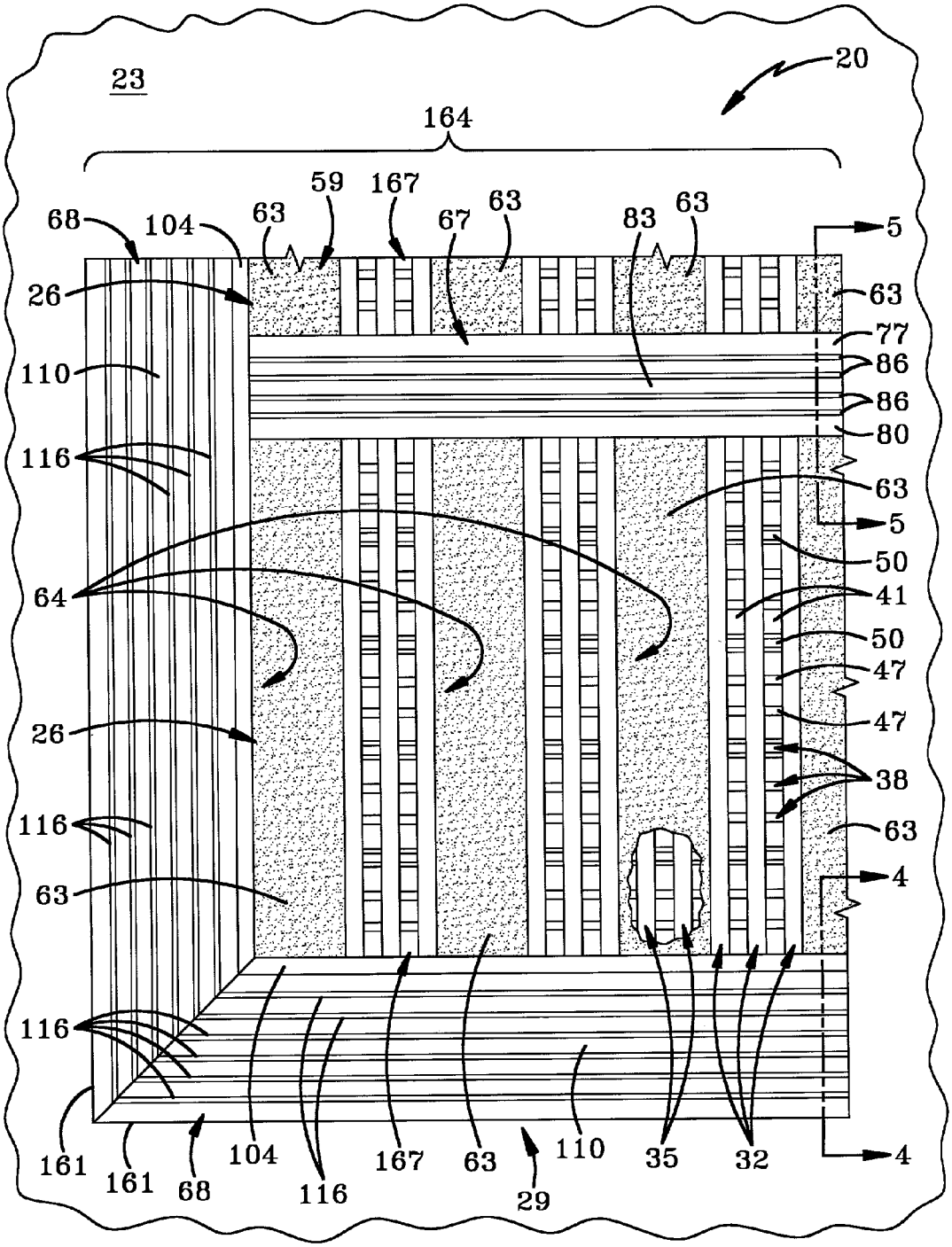
FIG. 1 is a fragmentary perspective top plan view of the floor mat system of the present invention, including a frame assembly and a plurality of floor mats.
Figure 3:
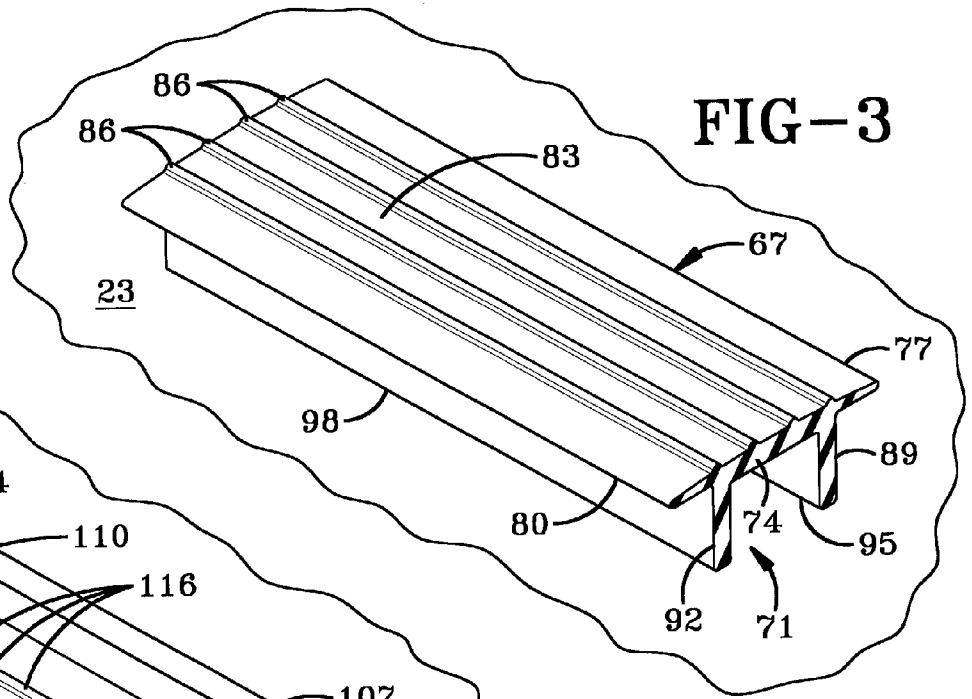
FIG. 3 is a perspective view of an inner frame member of the frame assembly shown in FIG. 1.
Figure 2:
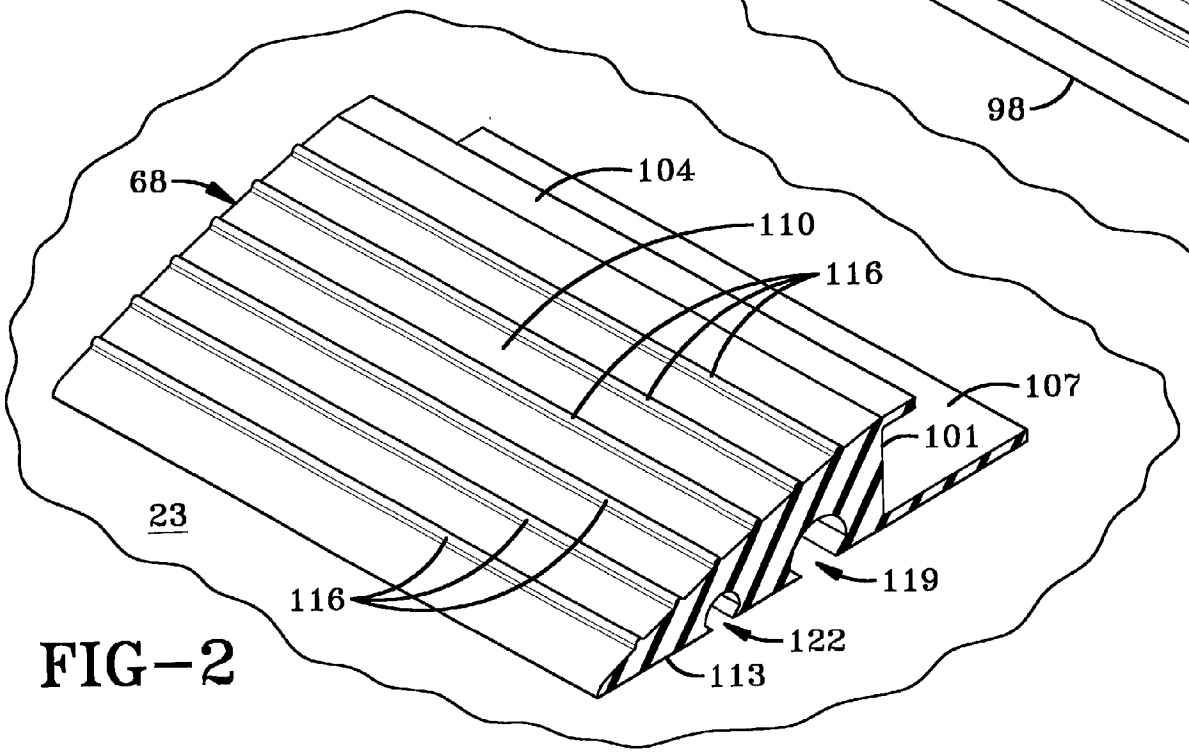
FIG. 2 is a perspective view of an outer frame member of the frame assembly shown in FIG. 1.
Figure 4:
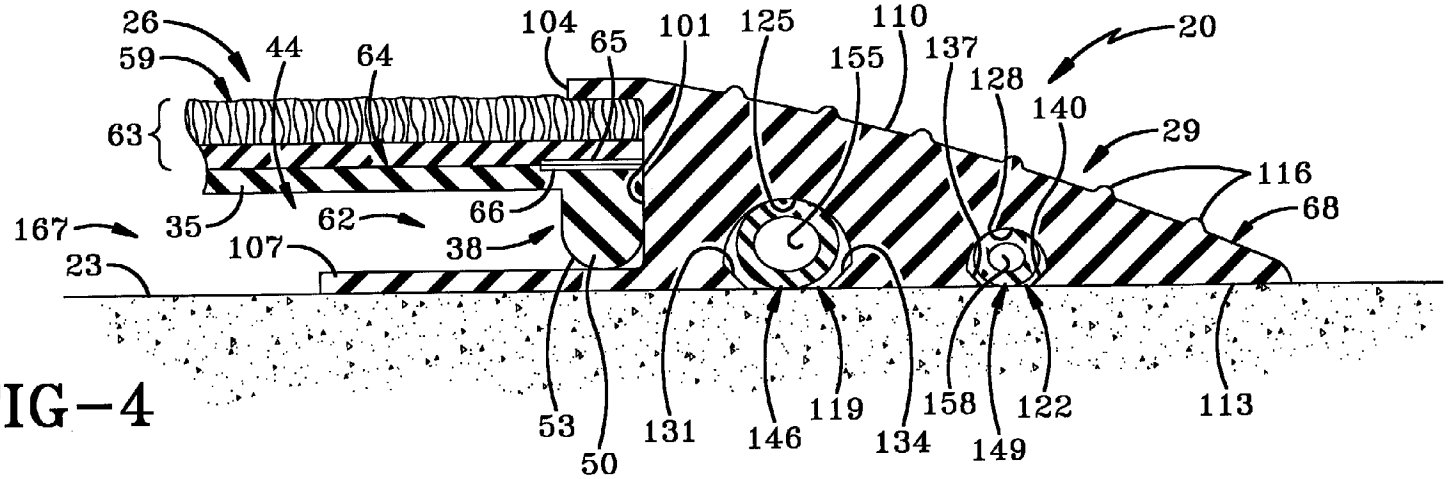
FIG. 4 is a fragmentary sectional view taken along line 4—4, FIG. 1.
Figure 5:
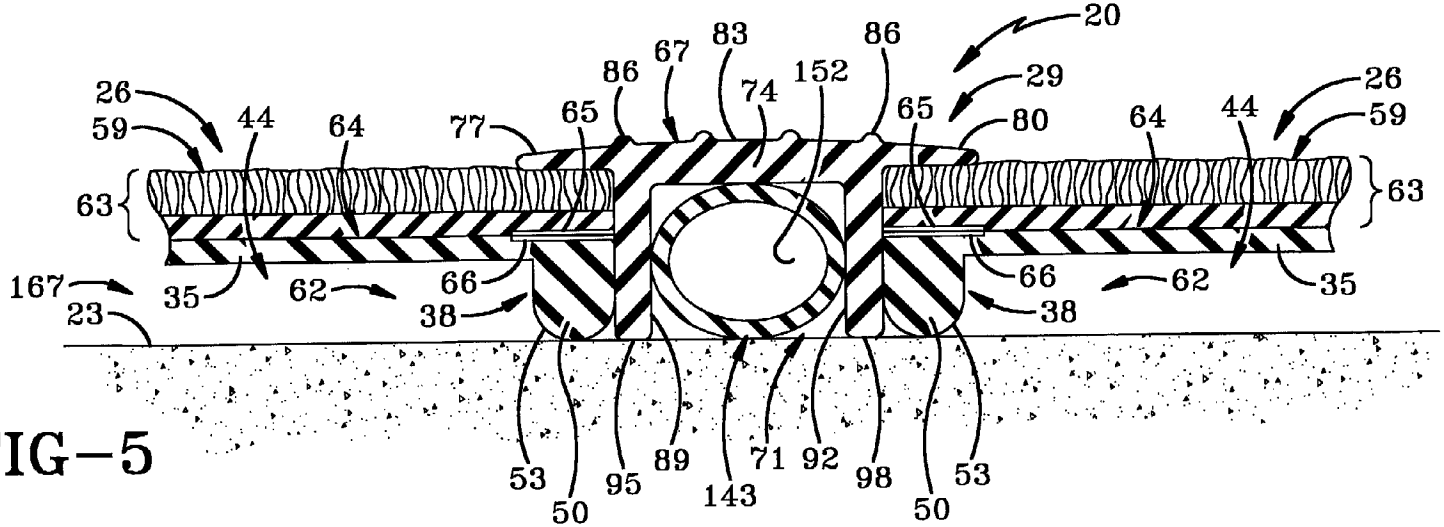
FIG. 5 is a fragmentary sectional view taken along line 5—5, FIG. 1.

The floor mat system of the present invention is shown in FIG. 1, being designated generally at 20, as positioned directly on a floor 23. System 20 includes a plurality of floor mats 26 and a frame assembly 29 (FIG. 1) which extends around and between floor mats 26. The floor mats 29 are typically about four foot by four foot square, but may be various sizes and shapes without affecting the concept of the invention. Floor mats 26 include a series of rectangular, parallel first and second ribs 32 (FIG. 1) and 35 (FIGS. 4 and 5). First ribs 32 are in groups of three spaced apart from one another by a distance equal to their respective widths. Second ribs 35 are in pairs of two which are spaced apart from one another, and from first ribs 32, by a distance equal to their respective widths. Second ribs 35 are slightly shorter in height than first ribs 32. A series of rectangular, parallel third ribs 38 extend perpendicular to and between first and second ribs 32 an 35 forming respective rectangular openings 41 (FIG. 1) and 44 (FIGS. 4 and 5) therebetween.

Third ribs 38 comprise of a pair of middle ribs 47 which extend between a pair of support ribs 50 having respective rounded bottoms 53. Third ribs 38 are shorter in height than first ribs 32, thereby along with second ribs 35, creating a sculptured upper surface 59 of floor mat 26. Rounded bottom 53 of each support rib 50 extends substantially below first ribs 32, second ribs 35, and middle ribs 47 thereby suspending the majority of floor mat 26 above floor 23, creating drainage channels 62 for water and debris which falls through the rectangular openings 41 and 44. A plurality of carpet sections 63 such as short nap pile carpet are removably connected to the second ribs 35 in respective carpet receiving recesses 64 formed by the first and second ribs 32 and 35 in the upper surface 59 using a plurality of hook fastener strips or patches 65 are affixed to the carpet sections 63 such as by sewing or riveting. A plurality of loop fastener strips or patches 66 are affixed to the second ribs 35 in the respective carpet receiving recesses 64 such as by using adhesives or rivets. Such hook and loop fastener patches 65 and 66 are removably interconnectable by pressing them together and peeling apart, commonly known under the trade name VELCRO™. A plurality of support legs (not shown) may extend downwardly to provide additional support against the floor.

Frame assembly 29 includes a plurality of inner frame members 67 and outer frame members 68 which extend between and around, respectively, floor mats 26. Inner frame members 67 are elongate, members of a hollowed T-shaped cross-section with a seal receiving recess 71. Innerframe members 67 include an upperwall 74 with respective transversely extending wings 77 and 80 adapted to extend over a peripheral portion the floor mats 29, and further include an upper surface 83. A plurality of spaced, parallel raised projections 86 are formed in upper surface 83, extending the entire length of inner frame members 67. A pair of side walls 89 and 92 are downwardly dependent from upper wall 74 defining seal receiving recess 71, side walls 89 and 92 having respective bottom ends 95 and 98.

Outer frame members 68 are elongate, generally triangular shaped in cross-section. Outer frame members 68 have an inner side surface 101 with respective upper and lower flanges 104 and 107 extending perpendicularly therefrom adapted to extend over a peripheral portion the floor mats 29, and angled upper surface 110 which is tapered downwardly away from upper flange 104. A bottom surface 113 extends horizontally from lower flange 107 to upper surface 110. Upper surface 110 includes a plurality of spaced, parallel raised projections 116 formed along the entire length thereof. Bottom surface 113 is formed with respective large and small seal receiving recesses 119 and 122 which are of a generally C-shape, having respective circular upper walls 125 and 128, and pairs of inwardly directed lower surfaces 131 and 134, and 137 and 140. Inner frame members 67 and inner frame members 68 are each of a constant cross-section and therefore are extrudable in plastic or aluminum materials thereby substantially reducing manufacturing costs for floor mat system 20.

Outer frame member may be manufactured without lower flange 107 without departing from the spirit of the present invention. Also, portions of frame assembly 29, or all of frame assembly 29 may be manufactured of vinyl without departing from the spirit of the invention.

A plurality of seals 43, 146, and 149 may be received into the respective seal receiving recesses 71, 119, and 122. Seal 143 is a generally tubular shaped member having a center hole 152 and is formed of a resilient material such as rubber. Seal 143 may be positioned within recess 71 of inner frame members 67, being sandwiched between inner frame members 67 and floor 23 during use. The downward pressure of inner frame member 67 causes seal 143 to deform to the oval shape shown in FIG. 5 creating a watertight seal between inner frame members 67 and floor 23. Seals 146 and 149 are also generally tubular shaped members having respective center holes 155 and 158 and are formed of a resilient material such as rubber. Seal 146 may be positioned within small seal receiving recess 122 of outer frame members 68 and seal 149 positioned within large seal receiving recess 119 of outer frame members 68. Seals 146 and 149 are sandwiched between outer frame members 68 and floor 23 during use. The downward pressure of outer frame member 68 causes seals 146 and 149 to deform to the oval shapes shown in FIG. 4 creating a watertight seal between outer frame members 68 and floor 23.

When assembled together, outer frame members 68 are placed on floor 23 so as to define a periphery 161 of an area 164 of floor 23 which floor mat system 20 is to cover. Each of outer frame members 68 have at least one of floor mats 26 abutting inner side surface 101 between upper and lower flanges 104 and 107. Inner frame members 67 divide the area 164 of floor 23 to be covered by floor mat system 20 into four by four foot wells 167 (FIG. 1). Inner frame members 67 have at least one floor mat 26 abutting each side wall 89 and 92 thereof. Each well 167 receives one of the floor mats 26, with the interlocking hook and loop strips 170 and 173 retaining the floor mats 26 and the frame assembly together, preventing floor mats 26 from sliding or otherwise moving when walked upon by people. The upper flanges 104 and wings 77 and 80 prevent peripheral edge portions of the floor mats 29 from lifting and creating a tripping hazard. Inner and outer frame members 67 and 68 may include a plurality of vertically dispose holes (not shown) for securing to the floor using a plurality f screws or bolts (not shown). The hook and loop strips 170 and 173 can also be affixed to the bottom periphery of the floor mats 26, and to respective lower wings (not shown) of the inner frame members 67 and to the lower flanges 107 of the outer frame members 68, or both.

Floor mats 26 including carpet sections 63 are supported by support ribs 50 at a height relatively even with the upper surface 83 of inner frame members 67 and the upper flange 104 of the outer frame members 68 creating a substantially flat floor mat system 20 with a sculptured upper surface 59 for scraping water and debris from people's shoes. Projections 86 of inner frame members 67 and the upper flange 104 of outer frame members 68 are slightly higher than floor mats 26 to create additional scraping edges to scrape water and debris from people's shoes. Upper surface 110 of outer frame members 68 is ramped to prevent people from tripping when stepping from floor 23 onto floor mat system 20.

Water and debris is scraped from the people's shoes flows through openings 41 into drainage channels 62 under floor mats 26. If a large area is covered by a plurality floor mats 26, the front most of floor mats will accumulate more water and debris from the people's shoes, eventually becoming completely full, while the rear most of floor mats 26 remain relatively dry. By selectively inserting or removing seals 143, 146, and 149 within the seal receiving recesses 71, 119, and 122 of the respective inner and 15s outer frame members 67 and 68, the water and debris can be more evenly distributed beneath floor mat system 20 to therefore contain more water and debris. For example, seal 143 may be removed or excluded from certain inner frame members 67 allowing the water and debris to flow in the direction desired creating an even distribution of the water and debris under floor mat system 20. Floor mats 26 will eventually have to be removed from wells 167 allowing the water and debris to be cleaned from wells 167. Floor mats 26 are placed back within wells 167 for further use. A floor drain (not shown) is preferably located below one or more of floor mats 268 to provide continuous drainage of water and debris from beneath floor mats 26. Seal 143 may be inserted within some of inner frame members 67 to create a desired flow of water to the drain. Also, seal 146 may be left out of a portion of one of outer frame members 68 in the event the drain is located outside or adjacent to floor mat system 20. The water and debris may be directed toward one side or end of floor mat system 20 creating a flow to the adjacent drain. Alternatively, floor mats 26 may be removed from wells 62 allowing the debris to be flushed from wells 167 with a water hose (not shown) with the directional flow along the drainage channels 62 allowing the flushing water to exit frame assembly 29 into the drain.

Floor mat system 20 may be adapted to cover virtually any size area 164 desired by making outer frame members 68 of a suitable length to enclose the periphery 161 of the area 164 and floor mats 26 of a suitable size to fit within the area 164. An appropriate number and length of innerframe members 67 necessary to divide the area 164 into the appropriate size wells 167 to receive the floor mats 26 may be included within outer frame members 68. Seals 143,146, and 149 may be placed within seal receiving recess 71 of inner frame members 67, and seal receiving recesses 119 and 122 of outer frame members 68 to direct the flow of water and debris within drainage channels 62 beneath floor mats 26.

The floor mat system 20 may be placed within a recessed area (not shown) formed in floor 23. In such a configuration, the outer frame members 68 are eliminated and inner frame members 67 may be inserted within the recessed area around the edge thereof to define the periphery 161 of the area to be covered by floor mats 26. These inner frame members 67 will thus have at least one floor mat 26 adjacent and abutting only one side thereof. Also, inner frame members 67 may be cut in any manner which allows the inner frame members 67 to form the desired size wells 167. For example, one piece inner frame members (not shown) extending transversely between longer one piece outer frame members (not shown) are of a length equal to the length of two of floor mats 26 plus the width of the inner frame member extending between the two floor mats 26. Further, it is understood that floor mats 26 and wells 167 may be other square or rectangular shapes such as three by three foot or three by five foot without departing from the inventive concept.

Accordingly, the improved floor mat system is much safer, simplified, provides an effective, safe, inexpensive, and efficient device which achieves all the enumerated objectives, provides for eliminating difficulties encountered with prior art devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved floor mat system is constructed and used, the characteristics of the construction, and the advantageous, new and useful results obtained; the new and useful structures, devices, elements, arrangements, parts and combinations, are set forth in the appended claims.

The invention claimed is:

1. A floor mat system adapted to lay on a floor, the floor mat system comprising:

at least one floor mat adapted to lay on the floor, said floor mat having a peripheral edge portion and including a plurality of parallel first ribs and a plurality of parallel second ribs which are disposed parallel to said first ribs, each of said first and second ribs having an upper surface wherein said upper surface of said first ribs are disposed above said upper surface of said second ribs, said first and second ribs each forming at least one group of first ribs and at least one group of second ribs such that a plurality of recessed carpet receiving areas are formed above said groups of said second ribs adjacent said groups of first ribs, and at least one generally rectangular piece of carpet that forms a portion of a top surface of said floor mat, at least one edge of said piece of carpet extending to said peripheral edge portion, said piece of carpet being securable to respective upper surfaces of the groups of second ribs within each of said recessed carpet receiving areas, said floor mat further including a plurality of third ribs extending substantially perpendicularly to said first and second ribs, a plurality of openings being defined by said first, second, and third ribs that provide fluid communication between the floor and atmosphere above said floor mat, said plurality of third ribs including at least one middle rib disposed between support ribs, said support ribs which are contactable with the floor to support said first and second ribs above the floor and to form drainage channels between the support ribs;

a frame assembly adapted to lay on the floor closely adjacent said floor mat, said frame assembly comprising at least one outer frame member; and wherein said outer frame member includes an inner side wall which is disposable adjacent said floor mat, and an upper flange that extends generally horizontally from an upper edge of said inner side wall so as to be overlapable with said peripheral edge portion of said floor mat including said piece of carpet when assembled thereto to prevent said piece of carpet from being lifted when walked upon.

2. The floor mat system defined in claim 1 in which the outer frame members have an angled upper surface which slopes downwardly from the upper edge of the inner side wall thereof to the floor.

3. The floor mat system defined in claim 2, wherein there are a plurality of support ribs with at least two middle ribs disposed between adjoining pairs of support ribs.

4. The floor mat system defined in claim 3, wherein each group of first ribs includes three first ribs, and each group of second ribs includes two second ribs.

5. The floor mat system defined in claim 1, wherein a lower surface of each of the middle ribs is substantially coplanar with respective lower surfaces of each of the first and second ribs.

6. The floor mat system defined in claim 1, wherein the bottom of each support rib is rounded.

7. The floor mat system as defined in claim 1, wherein the plurality of first and second ribs, and the plurality of third ribs are integrally molded together.

8. The floor mat system defined in claim 1, wherein the piece of carpet includes an upper surface which is substantially coplanar with respective upper surfaces of the first ribs.

9. A floor mat system adapted to lay on a floor, the floor mat system comprising:

at least one floor mat having a top surface and adapted to lay on the floor; the floor mat including a plurality of spaced first ribs and a plurality of spaced second ribs; the first and second ribs being elongated generally in the same direction; each of the first and second ribs having an upper surface wherein the upper surface of the first ribs are disposed above the upper surface of the second ribs; the first and second ribs each forming at least one group of first ribs and at least one group of second ribs such that at least one recessed carpet receiving area is formed above the at least one group of second ribs adjacent the at least one group of first ribs;

at least one piece of carpet that forms a portion of the top surface of the floor mat; the at least one piece of carpet being securable within the at least one recessed carpet receiving area;

the floor mat further including a plurality of spaced third ribs extending transversely to the first and second ribs whereby the first, second, and third ribs define a plurality of openings that provide fluid communication between the floor and atmosphere above the floor mat; the plurality of third ribs including a plurality of support ribs which are contactable with the floor to support the first and second ribs above the floor; and at least one outer frame member adapted to lay on the floor adjacent the floor mat; the outer frame member including an upper flange that extends over at least one edge of the at least one piece of carpet to prevent the at least one piece of carpet from being lifted when walked upon.

10. The system of claim 9 wherein the third ribs form drainage channels between the support ribs.

11. The system of claim 9 wherein the third ribs include at least one middle rib disposed between adjacent support ribs.

12. The system of claim 9 wherein the first and third ribs define a plurality of openings that provide fluid communication between the floor and atmosphere above the floor mat.

13. The system of claim 12 wherein the first and second ribs define a plurality of flow-through openings disposed below the at least one piece of carpet.

14. The system of claim 9 wherein the third ribs include at least one middle rib disposed between adjacent support ribs; and wherein each support rib has a bottom disposed below the at least one middle rib.

15. The system of claim 9 wherein said floor mat has a peripheral edge portion and wherein at least one edge of said piece of carpet extends to said peripheral edge portion; and wherein said outer frame member includes an inner side wall which is disposable adjacent said floor mat, and wherein the upper flange extends from an upper edge of said inner side wall so as to be overlapable with said peripheral edge portion of said floor mat including said piece of carpet.

16. The floor mat system defined in claim 15 in which the outer frame members have an angled upper surface which slopes downwardly from the upper edge of the inner side wall thereof to the floor.

17. The floor mat system defined in claim 16 in which the outer frame members have a lower flange that extends generally horizontally from a lower edge of the inner side wall so as to be overlapable with the peripheral edge portion of the floor mat when assembled thereto.

18. The floor mat system defined in claim 17, wherein the lower flange extends a further distance from the inner side wall than the upper flange.

19. The floor mat system defined in claim 15, wherein the floor mat includes a base to which the piece of carpet is securable, said base and said piece of carpet forming the top surface of said floor mat.

20. The floor mat system defined in claim 19, wherein the piece of carpet and the base are removably securable together.

21. The floor mat system defined in claim 20, wherein the piece of carpet and the base are removably securable together by a bottom surface of the piece of carpet and a corresponding upper surface portion of the base having mating patches of respective hook and loop fasteners affixed thereto.

22. The floor mat system defined in claim 15, further comprising at least one inner frame member of a generally T-shape, wherein respective wings of said inner frame member which extend horizontally therefrom to be overlapable with the peripheral edge portions of a pair of adjoining floor mats when assembled thereto.

23. The floor mat system defined in claim 15, wherein there are a plurality of outer frame members, respective ends of said outer frame members being adapted to closely fit together, said outer frame members which completely enclose said floor mat at the peripheral edge portion thereof to form an enclosed well.

24. The floor mat system defined in claim 15, wherein there are a plurality of outer frame members and a plurality of floor mats, respective ends of said outer frame members being adapted to closely fit together, and further including at least one inner frame member of a generally T-shape, respective wings of said inner frame member which extend horizontally therefrom to be overlapable with the peripheral edge portions of a pair of floor mats when assembled thereto, said outer frame members being adapted to completely enclose said floor mats at an outer periphery of said plurality of floor mats to form a plurality of enclosed wells.

25. The floor mat system defined in claim 24 in which the outer frame members have an angled upper surface which slopes downwardly from the upper edge of the inner side wall thereof to the floor, and in which said outer frame members have a lower flange that extends generally horizontally from a lower edge of the inner side wall so as to be overlapable with the peripheral edge portion of the floor mat when assembled thereto.

26. The floor mat system defined in claim 25, wherein the lower flange extends a further distance from the inner side wall than the upper flange.

27. The floor mat system defined in claim 15, wherein one of inner and outer frame members is made of vinyl.

28. The system of claim 9 further including at least one seal receiving recess formed in a bottom surface of said at least one outer frame member; and a seal disposable in each seal receiving recess for preventing the flow of water under said frame assembly.

29. The floor mat system defined in claim 28, wherein there are first and second parallel seal receiving recesses formed in the bottom surface of each outer frame member, and a pair of seals which are respectively disposable in said seal receiving recesses for preventing the flow of water under the frame assembly.

30. The floor mat system defined in claim 29, wherein the outer frame members have an angled upper surface which slopes downwardly from the upper edge of the inner side wall thereof to the floor; wherein the first seal receiving recess is closer to the inner side wall than the second seal receiving recess; and wherein the first seal receiving recess is of a larger size than the second seal receiving recess, each of said seals being of a corresponding size to a respective one of said seal receiving recesses.

31. The floor mat system defined in claim 30 wherein the first and second seals are tubular; wherein the seal receiving recesses are of a generally circular cross-section to receive the tubular seals; and wherein each seal receiving recess includes a downwardly-facing opening to permit the seals to contact the floor.

32. The floor mat system defined in claim 31, wherein each seal receiving recess includes a pair of inwardly directed lower surfaces adjacent the downwardly-facing opening.

33. The floor mat system defined in claim 28, wherein there are a plurality of outer frame members and a plurality of floor mats, respective ends of said outer frame members being adapted to closely fit together, and further including at least one inner frame member of a generally T-shape, respective wings of said at least one inner frame member extending horizontally therefrom to overlap opposite edge portions of adjoining floor mats when assembled thereto, said outer frame members being adapted to completely enclose said floor mats at an outer periphery of said plurality of floor mats to form a plurality of enclosed wells, and wherein said at least one inner frame member includes a seal receiving recess which extends upwardly opposite said wings, and a seal positionable within said seal receiving recess for preventing the flow of water under said inner frame member.

34. The system of claim 9 wherein the portion of the top surface of the floor mat which is formed by the at least one piece of carpet is less than the entire top surface.

35. The system of claim 9 wherein the openings include a plurality of openings which are unobstructed by the at least one piece of carpet.

36. The system of claim 15 wherein the at least one piece of carpet is free of a downward extension between the peripheral edge portion of the floor mat and the inner side wall of the outer frame member.

37. The system of claim 15 wherein the peripheral edge of the floor mat abuts the inner side wall of the outer frame member.

38. The system of claim 9 wherein the at least one recessed carpet-receiving area is a plurality of recessed carpet-receiving areas; and wherein the at least one piece of carpet is a plurality of pieces of carpet disposed in respective carpet-receiving areas.

39. The system of claim 19 wherein the base of the floor mat defines the at least one recessed carpet receiving area; and wherein the carpet receiving area is complementary to the at least one piece of carpet.

40. The system of claim 28 wherein the openings include a plurality of openings which are unobstructed by the at least one piece of carpet.

* * * * *